US009624799B1

(12) United States Patent
Ferguson

(10) Patent No.: US 9,624,799 B1
(45) Date of Patent: Apr. 18, 2017

(54) MULTI-MUFFLER SOUND ATTENUATOR ASSEMBLY

(71) Applicant: Schlumberger Technology Corporation, Sugar Land, TX (US)

(72) Inventor: Du'Bois Joseph Ferguson, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/046,891

(22) Filed: Feb. 18, 2016

(51) Int. Cl.
*F01N 1/06* (2006.01)
*F01N 1/10* (2006.01)
*F01N 13/00* (2010.01)

(52) U.S. Cl.
CPC ..... *F01N 1/06* (2013.01); *F01N 1/10* (2013.01); *F01N 13/002* (2013.01); *F01N 2230/02* (2013.01); *F01N 2230/04* (2013.01)

(58) Field of Classification Search
CPC . F01N 1/06; F01N 1/10; F01N 13/002; F01N 2230/04
USPC ..... 181/243, 212, 210
See application file for complete search history.

(56) References Cited

U.S. PATENT DOCUMENTS

| | | | | |
|---|---|---|---|---|
| 2,682,312 | A * | 6/1954 | Hopkins | F01N 1/003 138/39 |
| 2,805,730 | A * | 9/1957 | Applegate | F01N 1/125 181/252 |
| 7,770,690 | B2 * | 8/2010 | Schorn | F01N 3/2885 180/296 |
| 7,891,463 | B2 * | 2/2011 | Kruger | F01N 1/065 181/206 |
| 8,220,587 | B2 * | 7/2012 | Mori | F01N 13/1811 181/211 |
| 8,794,307 | B2 | 8/2014 | Coquilleau et al. | |
| 9,212,593 | B2 * | 12/2015 | An | F01N 13/0093 |
| 9,384,725 | B2 * | 7/2016 | Luecking | G10K 11/1782 |
| 2002/0033302 | A1 * | 3/2002 | Kaneko | F01N 1/089 181/232 |
| 2007/0220872 | A1 * | 9/2007 | Weimert | F01N 13/011 60/299 |

* cited by examiner

*Primary Examiner* — Forrest M Phillips
(74) *Attorney, Agent, or Firm* — Michael L. Flynn; Jody DeStefanis; Robin Nava

(57) ABSTRACT

A unitary, skid-type sound attenuator assembly for simultaneously managing sound from multiple sources. The assembly may include a dedicated muffler for each sound source. In turn, each of these mufflers includes an outlet for directing sound toward a location such as between the various mufflers of the assembly so as to provide an added level of noise cancellation. Additionally, the assembly may include an attenuator at such a common central location for further noise reduction. The attenuator may also serve a filtering function, for example where the sound sources are engines and the assembly is utilized for managing exhaust therefrom such as in an oilfield environment.

20 Claims, 5 Drawing Sheets

MULTI-MUFFLER SOUND ATTENUATOR ASSEMBLY

BACKGROUND

While a hydrocarbon well is often no more than a foot in diameter, overall operations at an oilfield may be quite massive. For example, stimulation operations at an oilfield may include fracturing applications that utilize 10-20 or more multiplex pumps with dedicated engines. These pumps and engines may act in concert through a manifold to drive a fracturing fluid at high pressure into the well. In this way fractures may be formed and propped open with hydrocarbon production being encouraged as a result. Specifically, the fractures may then serve as channels through the formation through which hydrocarbons may reach the wellbore. The indicated fracturing fluid generally includes a solid particulate referred to as proppant, often sand. The proppant may act to enhance the formation of fractures during the fracturing operation and may also remain primarily within fractures upon their formation.

Setting aside the massive amount of equipment placed at the oilfield for such operations, the pumps and even more so the engines for the pumps may present a sizeable noise issue for operators and areas around the oilfield. For example, in such operations, the pumps and engines generally operate continuously for several hours at a time. Further, during operations, each engine may emit in excess of about 75-100 dB. As described below, this level of audible noise may be hazardous to operators on site and present a nuisance to communities and areas adjacent the oilfield.

Direct exposure to more than 85 dB for any extended period of time is generally considered a health hazard. However, as a practical matter, it is not possible to restrict operator access to the oilfield throughout such stimulation operations. That is, a regular need to access pumps, engines and other nearby equipment for sake of minor tool adjustments, monitoring and other manual inspections is necessary. Once more, it would not be practical to shut down operations each time the need for such an adjustment or inspection presented itself. Thus, it is quite common for operators to spend time on site in a generally noise-proof trailer and then put on ear safety equipment when the need arises for leaving the trailer.

Unfortunately, ear safety equipment is far from full proof. For example, commonly available ear muffs and plugs are only effective when worn. That is, the possibility of the operator wearing such personal protection requires affirmative compliance by the operator. If an operator loses, breaks, or just forgets his or her ear safety equipment when leaving the trailer, he or she may be exposed to hazardous levels of noise. Once more, even when worn, another issue is presented. Namely, whether due to engine noise or ear protection, audible communication with the operator is compromised whenever the operator is present at the oilfield with engines running as described above. Thus, compromised communications which limit safe instruction and forewarning to operators may lead to increased risk of injury regardless of, and perhaps even due to, proper use of ear safety equipment.

With ear protection limitations in mind, additional efforts are generally undertaken to limit or "muffle" the amount of noise emitted from engines during operations. Specifically, pump engines are generally each outfitted with conventional industrial mufflers. For a standard diesel engine suitable for driving an oilfield multiplex pump, this may cost-effectively reduce noise output to below about 85 dB. However, this is generally not considered sufficient enough of a reduction to allow operators to safely forego ear protection for an extended period. Once more, this level of noise reduction also fails to fully eliminate the audible nuisance presented to areas adjacent the oilfield that are still faced with the running of multiple diesel engines on an ongoing basis.

With these remaining issues in mind, conventional industrial mufflers may be replaced with substantially larger hospital grade mufflers. In this way, noise may be substantially reduced to well below 80 dB at each engine. Unfortunately, however, these types of mufflers are substantially larger and more costly than those of the conventional variety. Specifically, these mufflers may drive up engine equipment expenses by about 20% and add an extra 400-500 lbs. or more to each engine. Once more, in conjunction with the added effort required to move and manage the added load, the associated skid or mobile platform for the pump and engine may require some modification to accommodate the increased equipment size.

The added challenge of utilizing a heavier and more expensive muffler is magnified depending on the number of dedicated pumps and pump engines utilized at the oilfield. That is, recalling that the operations may employ 10-20 or more pumps, the total challenge grows as the number of pumps utilized grows. In terms of dollars alone, an added $3,000 may be expected per hospital grade muffler. Thus, the increase may be $30,000-$60,000 or more in added expense depending on the particular operation setup. Furthermore, even where utilized, the reduction in noise is unlikely to be so dramatic as to eliminate all nuisance noise with respect to areas adjacent the oilfield during operations.

SUMMARY

A muffler assembly for attenuating sound from multiple sources is provided. The assembly may include multiple attenuators or mufflers, each dedicated to a particular sound source. The mufflers include an inlet for coupling to its corresponding source as well as an outlet to direct sound therefrom. Specifically, the outlets are configured to direct sound to a location for attaining a degree of sound cancellation.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments are described with reference to certain stimulation operations at an oilfield. Specifically, a host of pumps with dedicated engines and other equipment are referenced for supporting a stimulation application. However, other types of operations may benefit from the embodiments of multi-muffler sound attenuation through a common assembly as detailed herein. Indeed, even operations outside of the oilfield where multiple sources of noise are found may take advantage of the noise cancelling assemblies described herein. So long as mufflers are coupled to corresponding sound sources and oriented relative one another for noise cancellation in an assembly, appreciable benefit may be realized.

Figure 1:
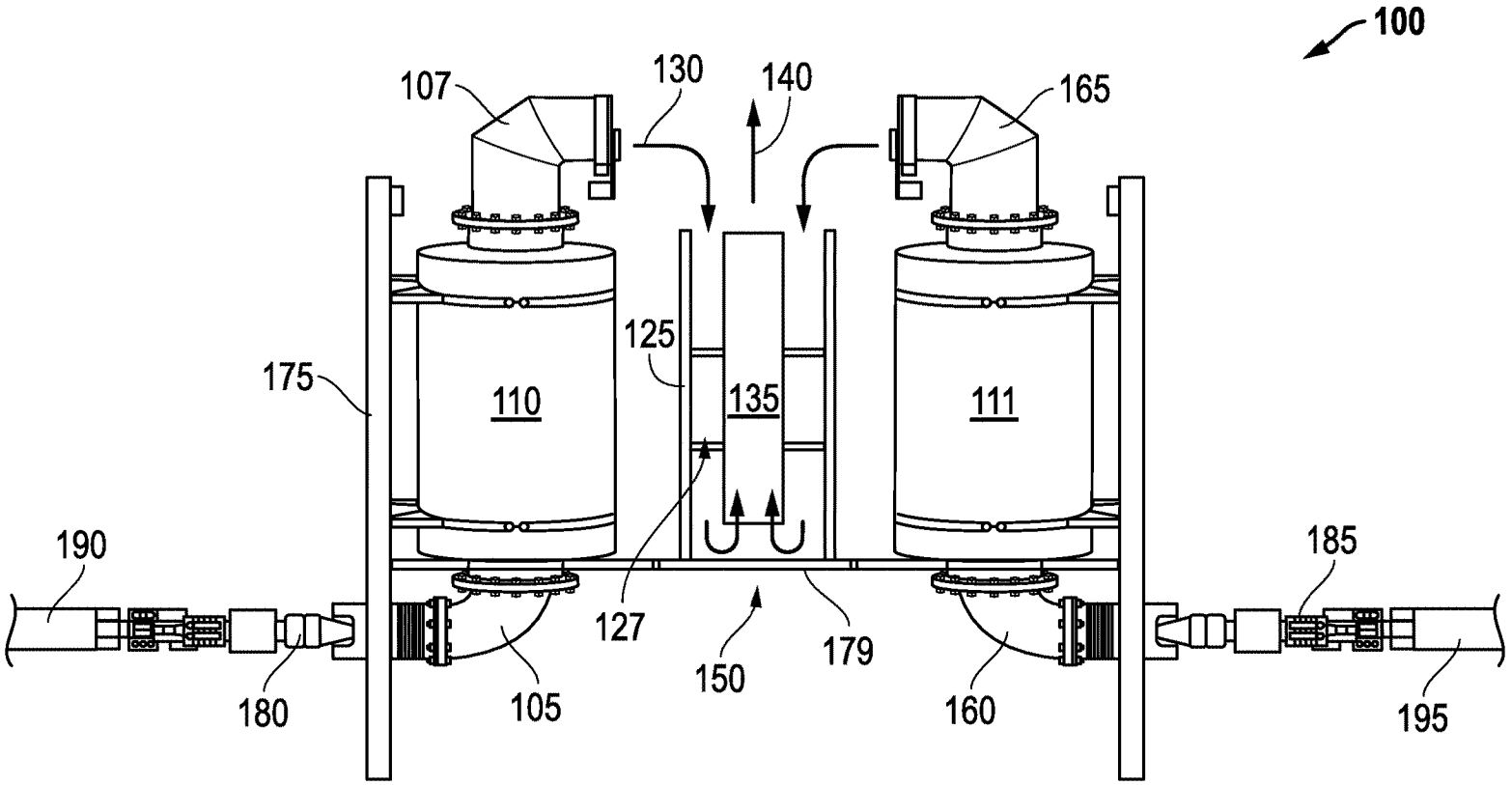
FIG. 1 is a side view of an embodiment of a multi-muffler sound attenuator assembly for use at an oilfield.

Referring now to FIG. 1, an embodiment of a multi-muffler sound attenuator assembly 100 is shown. The assembly 100 may be configured for use at an oilfield 300 in skid form as shown in FIG. 3. However, the assembly 100 may also be utilized in conjunction with other types of operations outside of an oilfield environment where multiple engines or other discrete sources of substantial sound are utilized. Along these lines, in the embodiment shown, multiple muffler devices 110, 111 are shown that each connected to flexible duct tubing 190, 195 for coupling to their own sound source (e.g. engines 360-369 of FIG. 3). Further, additional muffler devices may be incorporated into the assembly 100 depending on the number of sound sources to be linked thereto. For example, with continuing added reference to FIG. 3, ten different engines 360-369 may be coupled to ten different muffler devices 110, 111, 210-217 at the assembly 100 (see also FIG. 2A).

Regardless of the particular number utilized, the muffler devices 110, 111 are oriented in a unique fashion for sake of noise cancellation. Specifically, as shown in FIG. 1, outlets 107, 165 of the devices 110, 111 are directed toward one another. So, for example, as a flow 130 of exhaust and sound leaves one muffler device 110, it interacts with another flow 130 of the same from another device 111 such that a level of noise cancellation may occur. For example, a conventional muffler might be expected to limit a standard oilfield diesel engine sound output to about 80 dB. However, where the muffler devices 110, 111 are oriented in an assembly 100 as depicted, the added sound cancelling effect may reduce sound to substantially below 80 dB. That is, without the requirement of added internal muffler structure, materials or other expenses, commonly available muffler device types may be assembled together as part of a unique architectural assembly 100.

The noise cancelling obtained may be tailored for the greatest level of synergistic effect and other desired characteristics. For example, opposite outlets 107, 165 may be oriented to direct flow 130 right at one another for maximum noise cancellation as between the two muffler devices 110, 111. However, as discussed further below, they may also be angled in such a way as to promote flow 130 downward and toward an attenuating filter 150 for further noise reduction and exhaust filtering before release (see arrow 140).

In other embodiments, rather than aligning outlets 107, 165 pointed directly at one another, they may be directed at a common central location, generally between the muffler devices 110, 111. For example, in one embodiment, there may be an odd number of muffler devices 110, 111 coupled to an odd number of engines. Nevertheless, the outlets 107, 165 may be pointed toward a central location relative all of the devices 110, 111 with a noise cancelling effect still obtained. Indeed, with added reference to the top view illustration of FIG. 2B, it is perhaps more apparent that even if an odd number of devices 110, 111 were utilized, noise cancellation would still be attainable so long as all the employed outlets 107, 165 are directed toward a central location (e.g. toward the attenuating filter 150).

Continuing with reference to FIG. 1, as indicated above, the assembly 100 includes the muffler devices 110, 111 secured to a frame 175. So, for example, with added reference to FIG. 3, the assembly 100 may be positioned at an oilfield 300 in skid form. Of course, regardless where positioned, each device 110, 111 includes an exhaust inlet 105, 160 for reception of exhaust and sound flow from engines or other discrete sources of sound. In the embodiment shown, manually flexible duct tubing 190, 195 from such sources of sound are connected to the inlets 105, 160 by way of a quick connect acoustic coupling 180, 185 well suited for use in an oilfield environment. Indeed, these same type of couplings 180, 185 may be at the other end of the duct tubing 190, 195 for connection to engines 360-369 from which the exhaust and sound flow 130 originates. In an embodiment, the skid frame 175, or the base 177 thereof are rotatable in a carousel-like manner. In this way, an operator in the real world environment of an oilfield 300 may have an easier time manually accessing and connecting the couplings 180, 185.

As also indicated above, an attenuating filter 150 is positioned at a base 177 of the skid frame 175. The filter 150 may include a central attenuator 135 that is suspended within a support frame 125. As shown, flow 130 of exhaust and sound from the muffler devices 110, 111 may be channeled through an annular space 127 and then routed through the attenuator 135 which serves to both attenuate the sound and filter the exhaust of the flow 130 akin to an extended tailpipe. Thus, as detailed below with reference to FIG. 4, an added level of attenuation is achieved above and beyond that attained from the muffler devices 110, 111 separately and in concert via noise cancellation as described above. Additionally, the central attenuator 135 or the entire attenuating filter 150 may itself be of a vertically rotatable configuration. For example, a rotatable portion 179 of the base 177 may rotate the attenuating filter 150 as flow 130 is directed therethrough to help distribute exhaust and sound during operation.

Figure 2A:
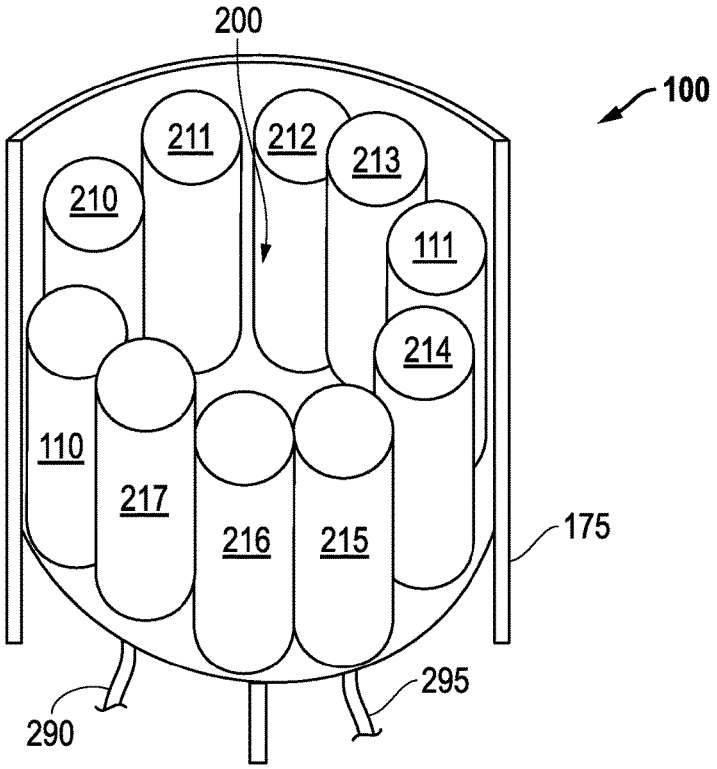
FIG. 2A is a perspective and partially cross-sectional schematic view of the multi-muffler assembly of FIG. 1.
Figure 3:
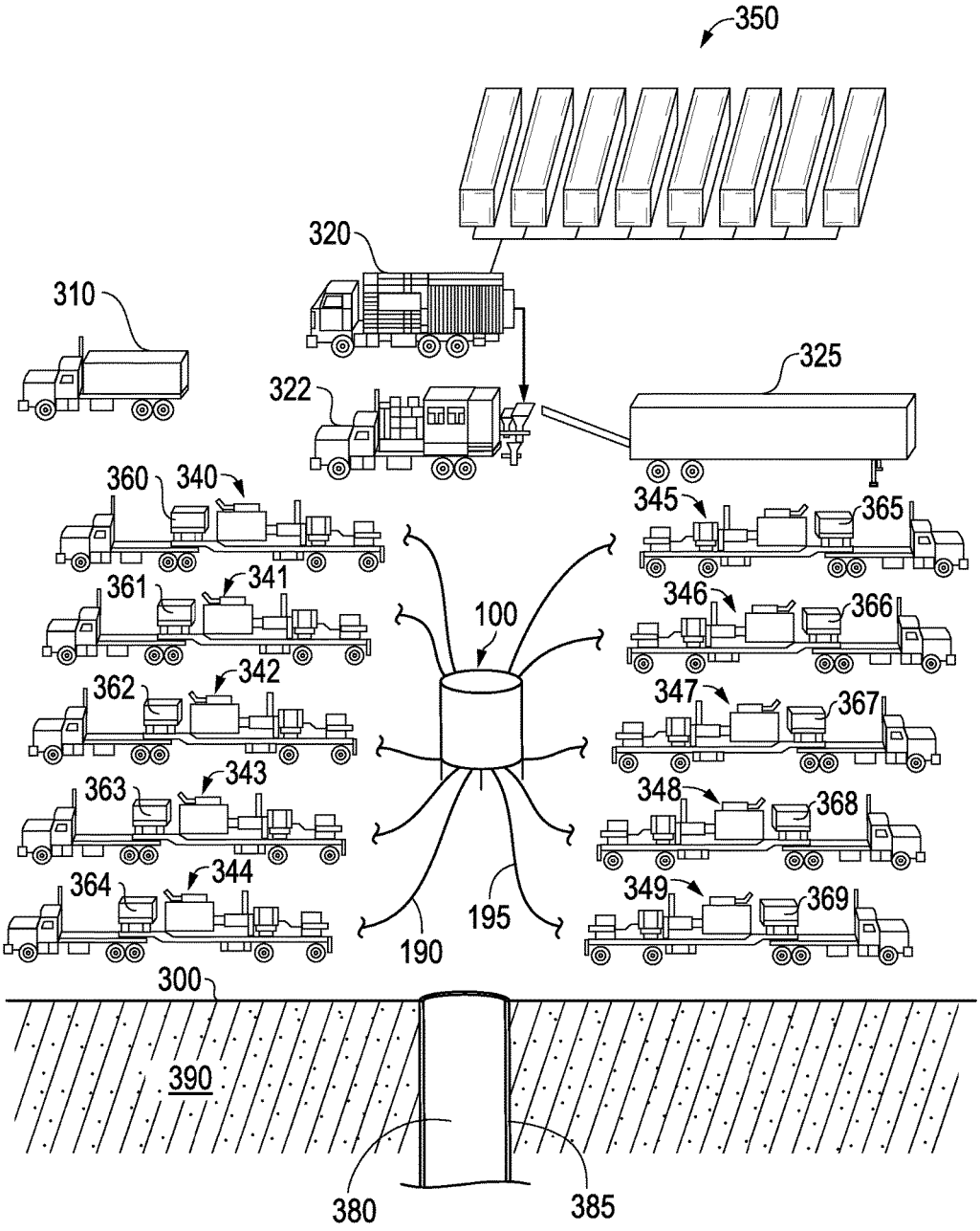
FIG. 3 is an overview depiction of an oilfield with a plurality of pumps having dedicated engines for coupling to the multi-muffler assembly of FIG. 1.

Referring now to FIG. 2A, a perspective and partially cross-sectional schematic view of the multi-muffler assembly 100 of FIG. 1 is shown. In this illustration, the cluster, carousel-type architecture of the various muffler devices 110, 111, 210-217 is more apparent and additional duct tubing 290, 295 is shown for more of the muffler devices (e.g. 215, 217). In an embodiment, each of the devices 110, 111, 210-217 is a conventional reactive silencer of between about 5 ft. and about 7 ft. in height. Of course, in other embodiments, the devices 110, 111, 210-217 may be of differing sizes or types. For example, dissipative muffler configurations may be employed. Regardless, so long as the devices 110, 111, 210-217 are clustered in such a fashion so as to provide a common central area 200 therebetween where a flow of sound may be directed simultaneously from all devices 110, 111, 210-217, a synergistic noise cancelling effect may be achieved.

Figure 2B:
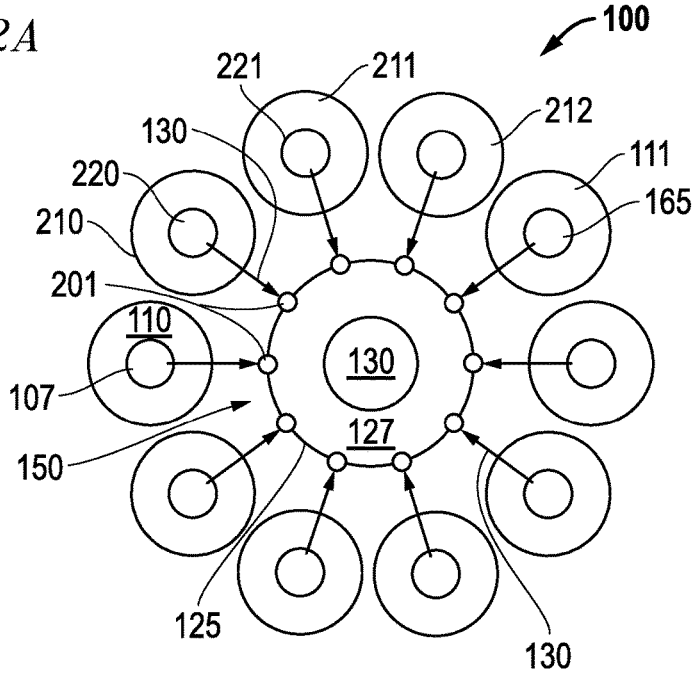
FIG. 2B is a top schematic view of the multi-muffler assembly of FIG. 1 highlighting sound directed at a central location.

Referring now to FIG. 2B, a top schematic view of the multi-muffler assembly 100 of FIG. 1 is readily apparent. In this view, the flow 130 of exhaust and sound toward a central location is shown. Specifically, the flow 130 is directed from outlets 107, 165, 220 of the muffler devices 110, 111, 210-217 toward the central attenuator 135 as described above. However, as also noted above, an embodiment may employ such central directing of flow for sake of attaining a substantial degree of noise cancellation even in the absence of any central attenuator 135.

In addition to the orientation shown in FIG. 2B and described above, alternative outlet orientation may be employed. For example, it is not necessarily required that the orientations of the outlets 107, 165, 220 be precisely directed at a general central location. In fact, where the assembly 100 utilizes a sizeable plurality of muffler devices 110, 111, 210-217, a variety of differently tailored orientations may also be utilized. For example, in an embodiment, immediately adjacent muffler devices 110 and 210 or 211 and 212 may orient their outlets (e.g. 107 and 220) at an angle offset from center, modified to a degree away from the direct central location and/or attenuator 135 and slightly toward one another. Thus, a greater degree of noise cancellation may take place even in advance of the flow 130 reaching the central location. In yet another embodiment, the orientation of every outlet 107, 165, 220, 221 may be slightly offset or modified to the same degree and the same direction away from pointing directly at the central location. Thus, flow 130 may proceed toward the central location while also taking on a clockwise or counterclockwise character relative the attenuator 135.

Continuing with reference to FIG. 2B, attaining a cyclonic flow pattern through the annular space 127 next to the central attenuator 135 may also be promoted through use of a fan or other device. Additionally, with added reference to FIG. 1, the entire filter 150 which houses the central attenuator 135 may itself rotate during operation of the assembly 100 so as to achieve an effect of cyclonic flow about the attenuator 135.

The embodiment of FIG. 2B also reveals the option of incorporating an array of "anti-noise" or noise cancelling generators 201. For example, conventional sound emitting generators 201 may be independently disposed about the frame 125 or other suitable location to allow for an orientation where a signal source, such as from the sound emitting generator(s) 201, may be sent to a phase compensator or the like which adjusts the sinusoidal output from the signal source 201 such that it is approximately 180 degrees out of phase with the noise pressure wave from the outlets 107, 165 of the devices 110, 111, thus creating a nodal wave that may be directed at the outlets (e.g. 165, 107). In an embodiment, the sound emitting generators 201 comprise a phase compensator as detailed hereinabove. That is, a mechanical sound of between about 50-5,000 Hz may be emitted from each generator 201 toward each outlet 165, 107 in advance of the flow 130 reaching the annular space 127. As a practical matter, considering equipment commonly utilized in an oilfield environment, this sound is likely to be of a more narrowly tailored lower frequency range of between about 60 and 500 Hz. However, other ranges may also be suitable depending on actual operating conditions. In one embodiment, the generators 201 include a diaphragm linked to a vibration generator which provides the anti-noise signal. Of course, a variety of other generator types, such as microphone amplification, may alternatively be employed.

Referring now to FIG. 3, with added reference to FIG. 1, an overview depiction of an oilfield 300 is shown with a plurality of pumps 340-349 having dedicated engines 360-369 for coupling to the multi-muffler assembly 100. The engines 360-369 may have a sound output of up to about 600 Hz with an exhaust flow 130 of up to about 400 ft./sec. to be managed by the assembly 100. As indicated above, the assembly 100 is of a unitary frame, mobile and perhaps rotatable in a carousel-like manner for allowing an operator to hook up various duct tubing 190, 195 via quick connects in a user friendly fashion. Additionally, the tubing 190, 195 may be flexible and constructed to minimize engine back-pressure. Thus, the use of the tubing 190, 195 does not noticeably affect engine performance.

In an embodiment, the tubing 190, 195 is of a dampening configuration for added noise reduction. For example, the tubing 190, 195 may be of a durable material with features such as predetermined leak points to reduce velocity, internal baffling and/or sound absorbing materials. Further, the tubing 190, 195 may be of an extended length between about 30 and 300 meters thereby serving as another form of tailpipe extension. In another embodiment, a substantial portion of the tubing 190, 195 may be placed within a trench at the oilfield 300 which in turn may or may not be covered over. Overall, through such added measures, an added 10-40 db reduction or more in noise level may be expected where the tubing 190, 195 is of such a dampening configuration.

FIG. 3 depicts a typical layout for a stimulation or hydraulic fracturing system with common equipment for such operations. For example, the pumps 340-349 and engines 360-369 referenced above are each part of a mobile pump truck unit. Thus, once properly disconnected, a pump 340-349 may be driven away and perhaps replaced by another such mobile pump if necessary. Further, a mixer 322 is provided that supplies a slurry for eventual use in a stimulation application in the well 380. In the embodiment shown, the well 380 is outfitted with casing 385 traversing a formation 390 and may have been previously perforated and now ripe for stimulation. Indeed, pressures of between about 7,500 psig and 15,000 psig or more may be provided by the pumps 340-349 for sake of driving a stimulation application.

The mixer 322 is used to combine separate slurry components. Specifically, water from tanks 350 is combined with proppant from a proppant truck 325. The proppant may be sand of particular size and other specified characteristics for the application. Additionally, other material additives may be combined with the slurry such as gel materials from a gel tank 320. From an operator's perspective, this mixing, as well as operation of the pumps 340-349 and engines 360-369 may be regulated from a control unit 310 having suitable processing and electronic control over such equipment.

With all of the noted equipment in use for the operation, a substantial amount of sound is understandably generated. The majority of this sound may originate from the engines 360-369 due to the power requirements of the large scale pumps 340-349 configured for driving such high pressure applications. Nevertheless, the use of the attenuator assembly 100 may substantially reduce the sound actually heard by an operator or passerby at the oilfield 300. Specifically, when employed as detailed herein, noise reduction via the assembly 100 may keep sound to below about 80 dB without the requirement of substantially heavier, more expensive, hospital grade mufflers. Instead, more standard muffler devices 110, 111 but of unique orientation may be utilized together to constitute the majority of the assembly 100. (see also FIG. 1).

Figure 4:
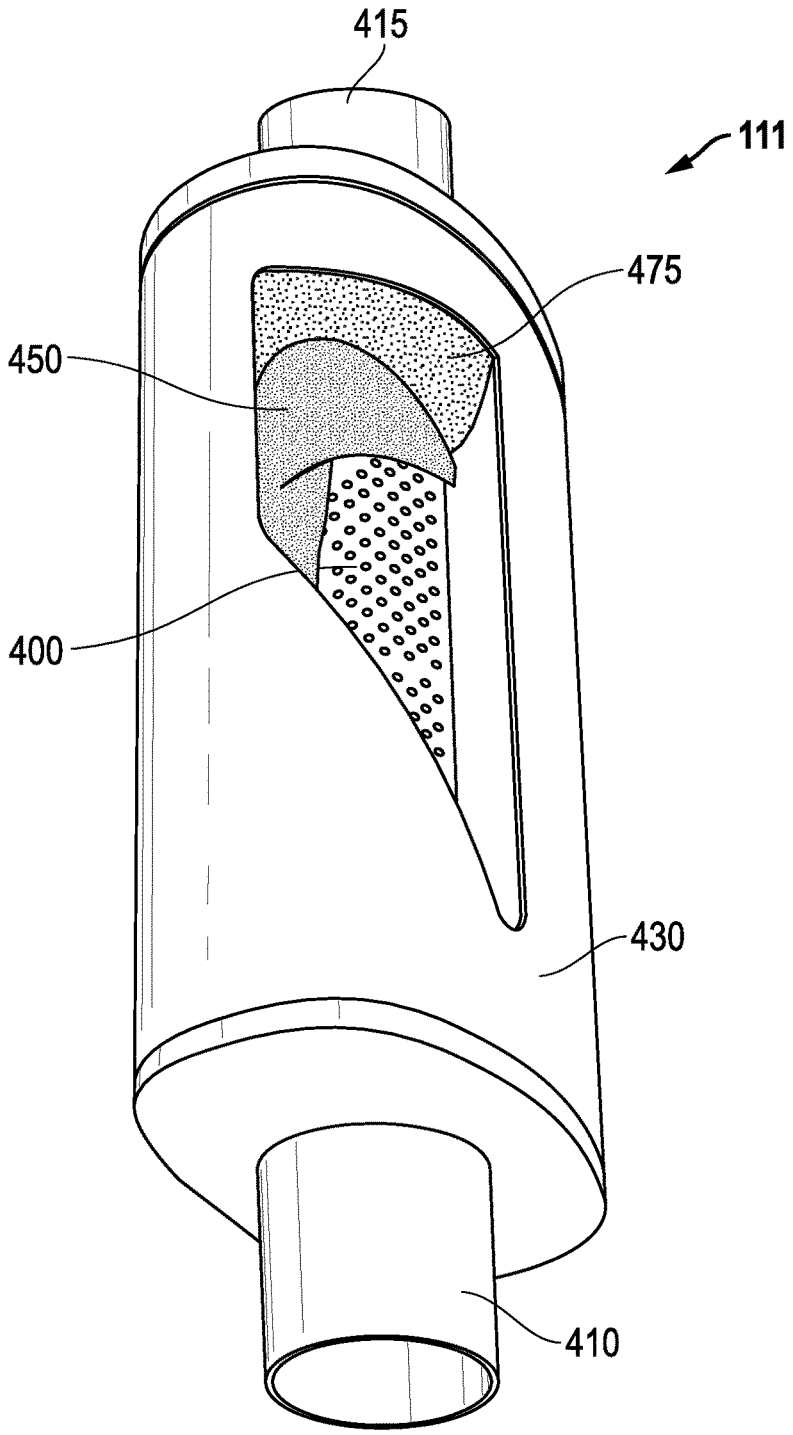
FIG. 4 is a perspective sectional view of muffler internal components for a device of the multi-muffler assembly of FIG. 1.

Referring now to FIG. 4, a perspective sectional view of internal components of a muffler device 111 for the multi-muffler assembly 100 of FIG. 1 is shown. In this embodiment, the device 111 is configured to receive the flow 130 in a directed fashion as described above. That is, the flow 130 of FIG. 1 may come into an intake 410 for subsequent emission at an output 415. Thus, a protective body 430 may be provided to define the exterior of the device 111. However, in other embodiments where the flow 130 is not as channelized or directed to a particular intake 410 location, the intake 410, outlet 415 and/or body 430 may not be utilized. Regardless, the device includes a perforated core 400 for sake of attenuating sound further beyond the noise cancelling that results from the unique multi-muffler orientation of the assembly 100 itself as described hereinabove.

In the embodiment shown, a sound absorbing material 450 may be positioned at the outer surface of the core 400 with acoustical suppression material 475 thereover. In an embodiment, the sound absorbing material 450 may be a thermally resistant open cell foam, steel mesh or other suitable material that also serves a filtering function relative the exhaust 130 (see FIG. 1). In an embodiment, this may include the capacity to reduce carbon dioxide, nitric oxides and other emissions, for example through conventional catalytic reduction and/or ammonia scrubber technology. Additionally, the use of an outer body 430 may help to define the space within which the mesh 450 and material 475 are located. How tightly packed with mesh 450 and material 475 the space is may depend on mesh 450 and material 475 characteristics. That is, the amount of each may be tailored for maximum sound reduction performance.

In another embodiment, the sound absorbing material 450 is configured to allow for a high rate of flow 130 without imparting substantial backpressure on the engines 360-369 (see FIG. 3). Additionally, in an embodiment where the engines 360-369 are natural gas in nature, the material 350 may be tailored for maximum sound attenuation and be of a non-filtering configuration (e.g. without regard to filtration aspects). Thus, the likelihood of imparting substantial backpressure may be further reduced.

Figure 5:
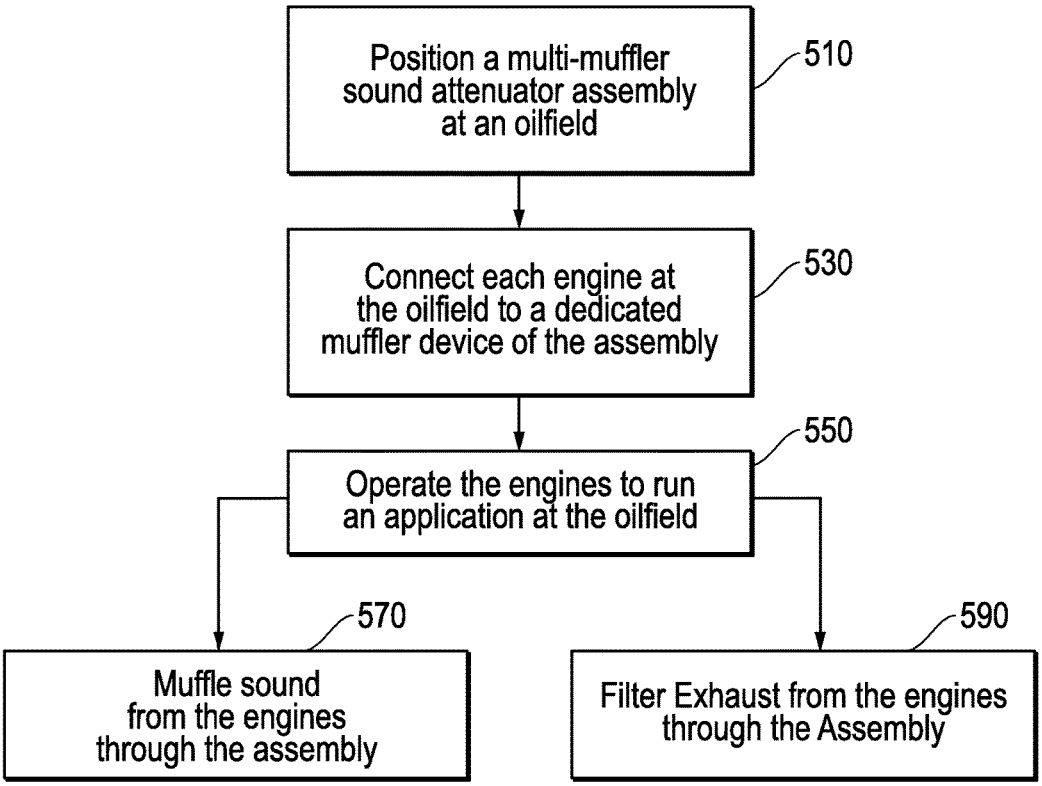
FIG. 5 is a flow-chart summarizing an embodiment of employing a multi-muffler sound attenuator assembly at an oilfield.

Referring now to FIG. 5, a flow-chart summarizing an embodiment of employing a multi-muffler sound attenuator assembly at an oilfield is shown. Specifically, the assembly is positioned at the oilfield as indicated at 510. As detailed hereinabove, the assembly may be fairly mobile and/or rotatable and equipped with quick connects for ease of hookup. That is, as noted at 530, each engine for each pump at the oilfield is directly hooked up to its own muffler device of the assembly in advance of operation as indicated at 550.

Continuing with reference to FIG. 5, with the engines operating, the assembly may muffle sound in a unique noise cancelling fashion as indicated at 570. This may be accompanied by added features to deal with sound and exhaust flow such as circulating flow about a central attenuator. Additionally, the assembly may also filter the exhaust simultaneous with attenuating sound as indicated at 590. Thus, ultimately cost-effective, light weight manner of attenuating sound and filtering exhaust may be achieved.

Embodiments described above allow for muffling of sound from multiple engines at an oilfield or other industrial location in a unique fashion. Specifically, a cost-effective manner of "muffling" to well below 80 dB per engine without the requirement of utilizing hospital grade mufflers or attenuators. Further, this may be achieved not only cost-effectively but also with an assembly that is separately provided and user friendly from a setup and workability standpoint. Indeed, the added equipment weight per engine may even be negligible or non-existent altogether.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

I claim:

1. A multi-muffler assembly for attenuating sound from multiple sources, the assembly comprising:

a first muffler device having a first inlet coupled to a first of the sources and a first outlet to direct muffled sound therefrom; and a second muffler device having a second inlet coupled to a second of the sources and a second outlet to direct muffled sound therefrom, the muffled sound from the first outlet directed to the muffled sound from the second outlet at a common location for attaining a degree of sound cancellation.

2. The assembly of claim 1 further comprising a mobile skid frame for accommodating the muffler devices in a unitary manner, the frame being rotatable to enhance user friendly manipulation.

3. The assembly of claim 1 wherein each of the muffler devices are one of a reactive silencer and a dissipative muffler configuration.

4. The assembly of claim 1 wherein the common location is a common central location of the assembly.

5. The assembly of claim 4 wherein the outlets are oriented substantially directly at the location for the sound cancellation.

6. The assembly of claim 4 wherein the outlets are oriented in an offset manner toward the location for the sound cancellation.

7. The assembly of claim 6 wherein the offset orientation promotes a cyclonic flow path for the sound relative the location.

8. The assembly of claim 1 further comprising a central attenuator at the location for further attenuating sound from the outlets.

9. The assembly of claim 8 wherein the attenuator is rotatable.

10. The assembly of claim 8 wherein one of the attenuator and one of the muffler devices comprises a body about the core for channeling sound therethrough.

11. The assembly of claim 10 further comprising a sound absorbing material between the core and the body.

12. An equipment system for positioning at an oilfield for running an application in a well, the system comprising:

a plurality of pumps for supplying pressure for running the application;

a plurality of engines for driving the pumps; and a unitary skid-based multi-muffler assembly for attenuating sound from the engines, the assembly comprising a plurality of muffler devices each dedicated to a one of the engines of the plurality of engines, each muffler device having an inlet to receive an exhaust flow from a one of the engines and an outlet, each of the outlets of each of the muffler devices directed to a common central location of the assembly for attaining a degree of sound cancellation of the plurality of engines.

13. The system of claim 12 further comprising:

flexible tubing for running between each of the engines and each muffler device dedicated thereto; and a quick connect coupling for connecting the tubing to one of the muffler device and an engine of the plurality of engines.

14. The system of claim 13 wherein the tubing is at least 30 meters long and of a dampening configuration with one of predetermined leak points, internal baffling, and a sound absorbent material lining.

15. The system of claim 12 wherein the multi-muffler assembly further comprises an attenuating filter at the common central location, the filter tailored to substantially avoid causing backpressure at the engines.

16. A method of attenuating sound from multiple sound sources, the method comprising:

positioning a multi-muffler sound attenuator assembly adjacent the multiple sound sources;

connecting each of the sound sources to a dedicated muffler device therefor of the assembly;

generating sound from each of the sources for distribution to each of the muffler devices, the muffler devices attenuating the sound from the sources; and directing muffled sound from each of the muffler devices toward an assembly location for an added level of sound attenuation via sound cancellation.

17. The method of claim 16 wherein the sound cancellation includes employment of at least one noise cancelling generator directed toward at least one of the devices.

18. The method of claim 16 wherein the directing of the muffled sound further comprises routing the muffled sound through an attenuating filter at the location.

19. The method of claim 18 further comprising filtering exhaust with the attenuating filter during the routing of the muffled sound therethrough.

20. The assembly of claim 18 further comprising circulating the muffled sound in an annular space adjacent the attenuating filter during the routing for enhanced distribution of the muffled sound about the attenuating filter.

* * * * *